United States Patent [19]

Coutier

[11] Patent Number: 4,664,225

[45] Date of Patent: May 12, 1987

[54] DEVICE FOR PREVENTING ACCESS TO LADDERS

[75] Inventor: Charles Coutier, Thionville, France

[73] Assignee: Etablissements Charles Coutier, France

[21] Appl. No.: 882,504

[22] Filed: Jul. 7, 1986

[51] Int. Cl.[4] ..... E06C 9/02

[52] U.S. Cl. ..... 182/77; 182/106; 182/128; 182/116

[58] Field of Search ..... 182/106, 77, 128, 78, 182/84, 115, 116, 93, 90

[56] References Cited

U.S. PATENT DOCUMENTS

| | | | |
|---|---|---|---|
| 2,535,544 | 12/1950 | McKinley | 182/106 |
| 3,038,555 | 6/1962 | Da Lee | 182/128 |
| 3,044,572 | 7/1962 | Thomas | 182/115 |
| 3,225,863 | 12/1965 | Ludlow | 182/77 |
| 3,968,857 | 7/1976 | Bryan | 182/106 |
| 4,524,848 | 6/1985 | Russo | 182/106 |

FOREIGN PATENT DOCUMENTS

| | | | |
|---|---|---|---|
| 151076 | 8/1985 | France | 182/77 |
| 431291 | 6/1975 | U.S.S.R. | 182/106 |

*Primary Examiner*—Reinaldo P. Machado
*Attorney, Agent, or Firm*—Gerald J. Ferguson, Jr.; Michael P. Hoffman; Ronni S. Malamud

[57] ABSTRACT

A panel (6) has a flap (9) for closing a person-passing opening (4') (e.g. leading into a ladder cage (4)) and is pivotally mounted to one of the risers of the ladder (1). A locking element (10) having a padlock-receiving hole (12) is pivotally mounted on the other riser (2) and is connected by a first link (14) to an intermediate lever (16) having a finger (23) for holding the panel (6) in its closed position, said intermediate lever being operable from inside the cage (24) by means of an operating lever (21).

15 Claims, 11 Drawing Figures

DEVICE FOR PREVENTING ACCESS TO LADDERS

The invention relates to a device for preventing unauthorized access to ladders of the kind which are to be found in numerous industrial installations. These ladders often lead to machinery which is dangerous when in operation, or to safety equipment as found in open air electricity installations, in oil refineries, in large railway stations, etc. It is thus desirable to restrict access to such ladders to authorized personnel.

BACKGROUND OF THE INVENTION

The invention is applicable to bare ladders or to ladders which are caged for protective purposes. A cage ends close to but not at the end of the ladder in order to facilitate access to the ladder.

Regulations exist which require the end hoop of a ladder cage to be provided with a flap which is hinged about a horizontal axis to enable the flap to be locked in the pane of the end hoop, thereby preventing access to the inside of the cage.

However, this technique does not prevent access to the portion of the ladder which extends outside the cage; in addition, once authorized persons have gained access to a cage by opening the flap (e.g. by letting it hang down from its hinge), it is extremely difficult for them to close the flap from inside the cage to prevent unauthorized access to the ladder while they are on it, or after they have left it by its other end.

Preferred embodiments of the present invention avoid the above drawbacks by providing a device for preventing access to a caged ladder in which access is simultaneously prevented both to the end hoop of the cage and to at least a part of the end portion of the ladder situated between its end rung and the end hoop.

Preferred implementations of the invention also provide a device of the above-defined type which can be closed and locked behind persons on the ladder inside the cage, and which can easily be opened, without using a key, when such persons seek to exit from the cage and leave the ladder.

Preferred embodiments of the present invention provide a device of the above-defined type which, in addition, automatically closes and locks behind a person on the ladder inside the cage.

In another aspect, the present invention is also applicable to ladders which are not caged, but which extend from a first level to a second level through a person-passing opening. A person at the first level and seeking to gain access to the second ladder by taking the ladder must pass through the opening.

Such an opening is comparable to the opening defined by the end hoop of a ladder cage. Consequently, in the following description, the term "person-passing opening" is used to designate any opening through which a person taking a ladder must pass in order to go from one level to another. If the ladder is caged, then the person-passing opening is constituted by the end hoop of the cage. If the ladder is uncaged, but passes through a hole in a floor or a deck, then that hole constitutes a person-passing opening.

SUMMARY OF THE INVENTION

The present invention provides a device for preventing access to a person-passing opening accessible via a ladder which extends between a first level and a second level at which said person-passing opening is situated, wherein a panel of width substantially equal to the width of the ladder and of height equal to at least a fraction of the difference between said first and second levels is mounted to pivot relative to the ladder, the end of said panel which is closest to said person-passing opening, when in use, being provided with a closure flap of a size suitable to close said person-passing opening sufficiently to prevent a person from passing therethrough, said flap being disposed to close said opening when said panel is itself in a closed position close to said ladder, said panel being further provided with locking and unlocking means for locking said panel in its closed position, and for unlocking it.

BRIEF DESCRIPTION OF THE DRAWINGS

Embodiments of the invention are described, by way of example, with reference to the accompanying drawings, in which.

MORE DETAILED DESCRIPTION

Figure 1:
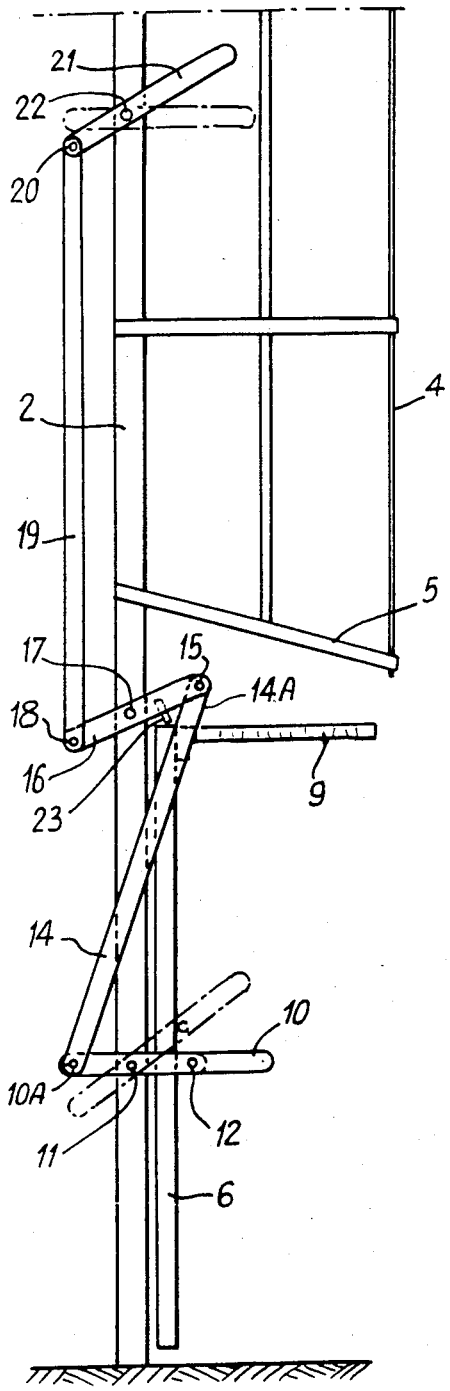
FIG. 1 is side view of the bottom of a caged ladder fitted with a first device in accordance with the invention.
Figure 2:
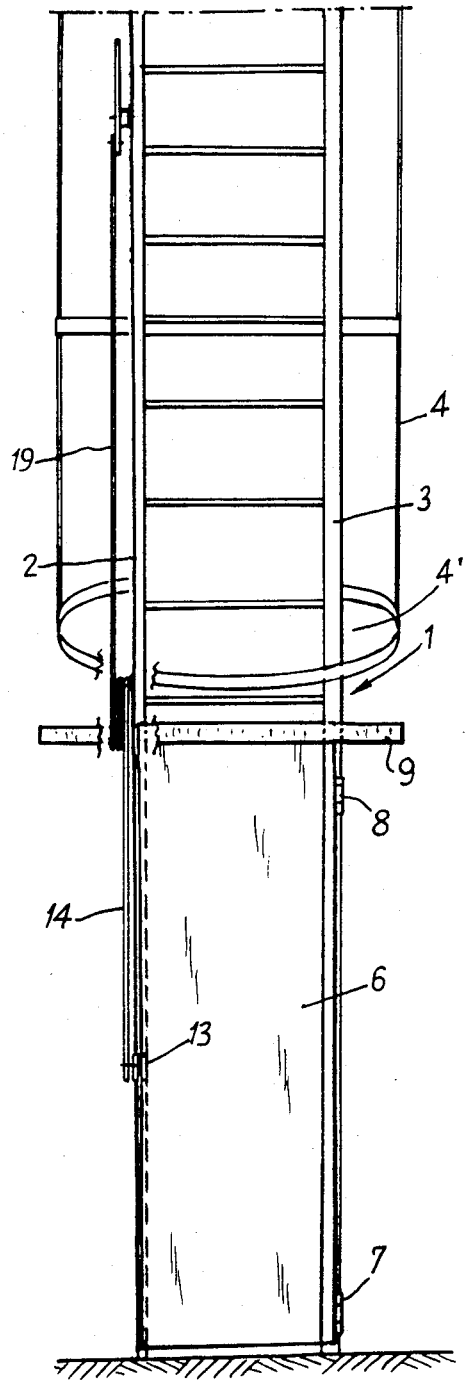
FIG. 2 is a front view of the same portion of the ladder as is shown in FIG. 1.

FIGS. 1 and 2 show a caged ladder intended to be accessed from its bottom end and having a bottom rung close to the ground and a bottom hoop of the cage at a height above the ground. The major portions of the ladder and of the cage are not shown, but extend upwardly from the portions shown in FIGS. 1 and 2, so the bottom of the cage and the bottom of the ladder are situated relatively close together compared with their overall lengths.

The ladder 1 has two risers 2 and 3 and is provided with a cage 4 whose bottom hoop 5 is about 2.3 m above the ground. The hoop 5 defines a person-passing opening 4'. A panel 6 having the same width as the ladder 1 is hinged along one of its longitudinal edges by two hinges 7 and 8 which are fixed to the riser 3 at two vertically separate points. The panel 6 extends at least from the bottom rung of the ladder to the bottom hoop of the cage. The top end of the panel 6 is provided with a closure flap or disk 9 of substantially the same size as the bottom hoop 5 and suitable for preventing access to the inside of the cage through the person-passing opening 4'.

A horizontal pivot shaft 11 projects from the riser 2 which is opposite to the riser 3 fitted with the hinges 7 and 8, and the middle of a locking element 10 is pivoted thereon. The locking element 10 has a hole 12 which is located in front of the panel 6 when in the closed position and which then corresponds with a matching hole in a locking tab 13 on the panel 6. A padlock can then be passed through the two holes in order to lock the panel 6 in its closed position.

The opposite or rear end of the locking element 10 is articulated at 10A to a first link 14 which extends upwardly to just above the closure flap 9. The first link 14 extends obliquely so that its bottom end is located behind the ladder 1 while its top end 14A is located in front of the ladder, and is articulated at 15 to one end of an intermediate lever 16 whose middle portion is pivotally mounted about a horizontal pivot shaft 17 mounted on the same riser 2 of the ladder as the locking element 10.

When the locking element 10 is horizontal, the intermediate lever 16 is inclined relative to the horizontal so that its front articulation 15 is uppermost. Its opposite or rear end is articulated at 18 with a second link 19 which extends upwardly parallel to the riser 2 for a length of about 1.5 m to a top end which is articulated at 20 to an unlocking lever 21. The middle portion of the unlocking lever 21 is pivoted about a horizontal axis 22 fitted to the same riser 2. The front end of the unlocking lever 21 projects into the cage 4 in order to make it easy to grip and to operate. It is constrained to move parallel to the intermediate lever 16.

At a point located between its pivot shaft 17 and its front articulation 15, the intermediate lever 16 is fitted with a stop finger 23 which points downwardly and which is suitable for entering a corresponding opening (not visible in the figures) provided in the thickness of the panel 6 when said panel is its closed position and said intermediate lever 16 is in a horizontal position.

The above-described device operates as follows.

In its protective or closed position, the panel 6 is close to the risers 2 and 3 or pressed against them or contained between them so that the bottom portion of the ladder 1 and the person-passing opening 4' are inaccessible. The locking element 10 is horizontal (as shown in solid lines) and a padlock is passed through the hole 12 in the locking element 10 and through the hole in the tab 13. The intermediate lever 16 and the operating lever 21 point upwardly (as shown in solid lines) and the stop finger 23 is not engaged in the corresponding opening provided in the panel 6.

When the padlock has been removed from the hole 12, the panel 6 can be opened and the ladder 1 climbed to enter the cage 4 via the person-passing opening 4'.

Once the person climbing the ladder is higher than the flap 9, the panel 6 can be reclosed, for example using a foot pressed down on the top of the flap 9. At this moment the unlocking lever 21 is accessible and it can simultaneously be moved to its horizontal position (as shown in dot-dashed lines), thereby putting the intermediate lever 16 into its horizontal position also and thus engaging the stop finger 23 in the corresponding opening in the closed panel 6. Simultaneously, the locking element 10 is raised to a sloping position as shown in dot-dashed lines.

Thus, the panel 6 is again held in its closed position, this time by the stop finger 23, but it is no longer possible to lock it from the outside since the hole 12 in the locking element 10 and the hole in the tab 13 are no longer in correspondence with each other.

Naturally, it would still be possible for an outsider to lower the locking element 10 to its horizontal position, thereby simultaneously raising the unlocking lever 21 and bringing the hole 12 into correspondence with the hole through the tab 13. An outsider could then lock a person in the ladder cage. In order to prevent such an occurrence, the unlocking lever 21 and the riser 2 of the ladder may be provided with respective holes (not shown) which come into correspondence when the unlocking lever 21 is in its horizontal position, thereby enabling a person inside the cage 4 to prevent the locking element from being moved until that person has left the cage.

In this preferred embodiment, the locking element 10 and the unlocking lever 21 operate in opposite directions so that when one of them is in a position to hold the panel 6 in its closed position the other one is not in a position to do so. In a variant, the locking element 10 and the locking lever 21 could be caused to operate in parallel so that they are both simultaneously in a locking position or in a non-locking position, in other words they could be arranged so that the stop finger 23 engages in the closed panel 6 at the same time as the hole 12 in the locking element 10 is aligned with the corresponding hole in the tab 13.

Figure 3:
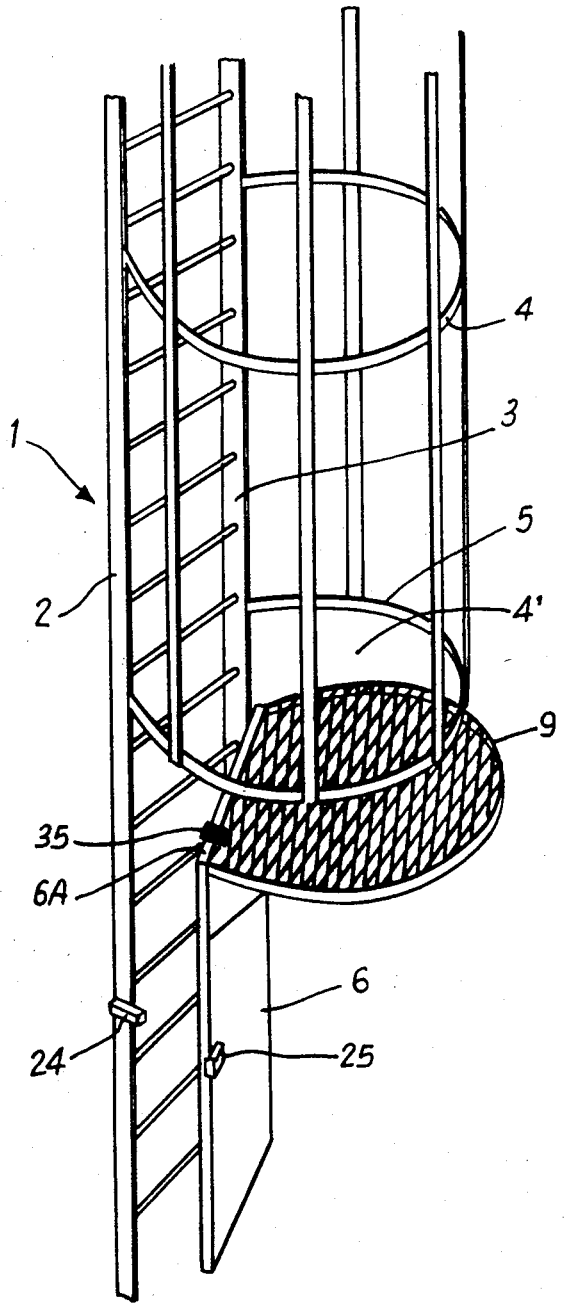
FIG. 3 is a perspective view of the bottom end of a caged ladder which is closed by a device in accordance with a preferred embodiment of the present invention.
Figure 4:
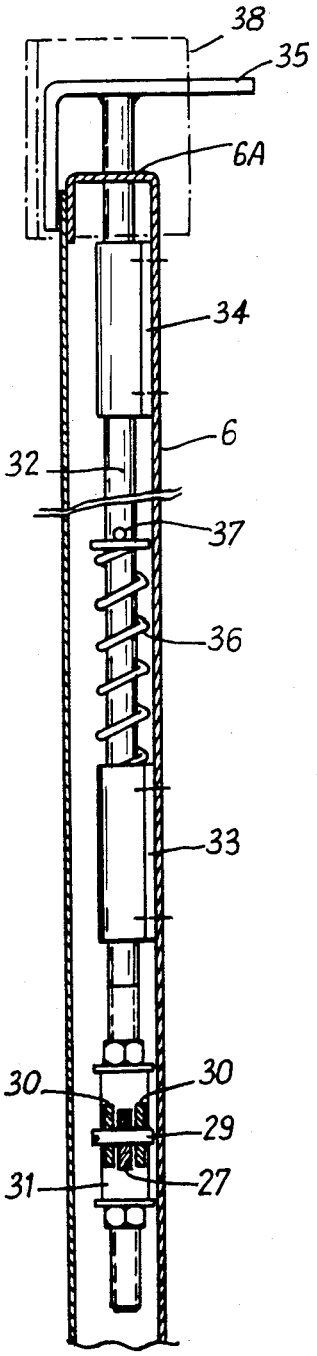
FIGS. 4 and 5 are fragmentary sections respectively showing a side view and a front view of the unlocking means for the FIG. 3 embodiment, with the closure flap not being shown.
Figure 5:
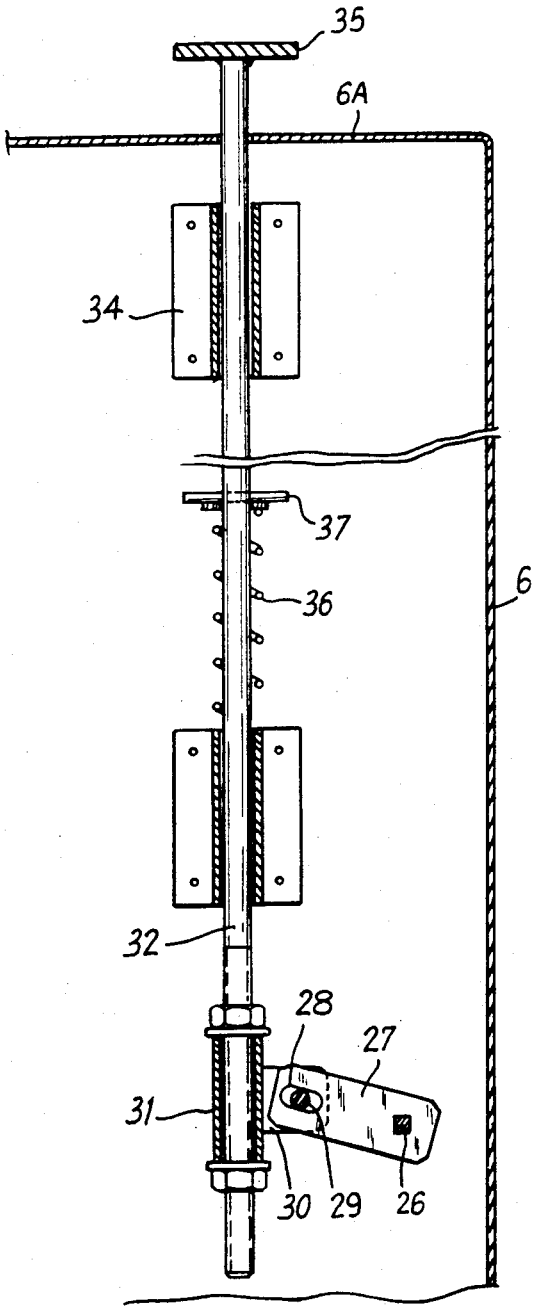

Reference is now made to FIGS. 3 to 5 in which items that are identical or equivalent to those described with reference to the example shown in FIGS. 1 and 2 have been given the same reference numerals as in said figures.

FIG. 3 shows the ladder 1 with its two risers 2 and 3, the cage 4, the pivoting panel 6 and its cage-closing flap or disk 9, and the person-passing opening 4'.

The locking means 10 comprises a closure member 24 fixed on the riser 2 and having a catch suitable for receiving a spring-type bolt of a lock 25 fixed in a corresponding position on the panel 6 and suitable for latching automatically when the panel is slammed shut. The lock 25 has an operating shaft 26 which enables the bolt to be moved, but the shaft 26 is not directly accessible from outside the lock 25. Nonetheless, and in conventional manner, a suitable key inserted into the lock 25 can be used from outside the panel 6 to move the bolt.

The panel 6 comprises two parallel walls leaving an empty volume in the thickness of the panel in which the operating shaft 26 extends in order to be provided with an operating part 27 (see FIG. 5). The operating part 27 has an end portion 27A with an oblong slot 28 therein slidably receiving a peg 29. The peg 29 is held between the arms 30 of a fork 31 with the arms 30 extending over respective sides of the end portion 28 of the operating part 27.

The fork 31 is fixed to a sliding rod 32 which is guided along the thickness of the panel 6 by guide sleeves 33 and 34 which are fixed to one of the walls of the panel. The rod 32 extends upwardly from the lock 25 to project a short distance above the top edge 6A of the panel. The top of the rod 32 is provided, above the panel 6 and above the closure flap 9, with a thrust pedal 35.

A compression spring 36 surrounds a portion of the length of the sliding rod 32 and bears at one end against the guide sleeve 33 and at its other end against a pin 37 which passes through the rod 32. The rod 32 is thus permanently biased in an upward direction as shown in FIGS. 3 to 5 such that the pedal 35 is at its high point above the closure flap 9 and the bolt is engaged in the catch when the panel 6 is in the closed position.

In this example, the panel 6 is mounted to return automatically to its closed position under the effect of any suitable conventional return means such as a spring, a counterweight, or by virtue of its hinges being offset from the vertical. Such automatic closure may also be provided for the embodiment shown in FIGS. 1 and 2. With automatic closure, once a person has opened the panel 6 using the key to the lock 25 and has climbed into the cage 4, the panel 6 closes automatically. The spring bolt engages automatically in the catch 24. The panel 6 is again locked against any person who does not possess the key. However, when the person inside the cage comes down the ladder, the lock can be unlocked merely by applying foot pressure on the pedal 35 to cause the slide rod 32 to move downwardly and cause the shaft 26 to turn, thereby unlocking and opening the panel 6.

Preferably, the pedal 35 is surrounded on three sides by a guard plate 38 (as shown in dot-dashed lines in FIG. 4) in order to prevent access thereto from outside the cage.

It may be observed that the locking means and the unlocking means of the preferred embodiment need not be used in conjunction with automatic panel closure means, if so required.

FIGS. 6 to 9 relate to an embodiment of the device in accordance with the invention for use with a ladder which extends downwardly from a platform 39. When referring to items which are identical or equivalent to those described above, the following description uses the same references as have been used for the previous figures.

The risers 2 and 3 of the ladder 1 extend, without rungs, above the level of the platform 39. These extensions may be constituted by integral portions of the risers 2 and 3 themselves, or they may be constituted by items added to the ends of the risers, or they may be constituted by portions of a guard rail 40 (shown in part only) which surrounds the edge of the platform 39. Regardless of the case which applies in a given situation, the following description will assume that the risers 2 and 3 extend as far as the top of the guard rail 40. The rungs of the ladder terminate with a top rung 1A which is located substantially level with the platform 39. The top hoop 5 of the cage 4 is substantially level with the top of the guard rail 40, and delimits a person-passing opening 4'. The panel 6 and the closure flap 9 are mounted on the riser 3 by means of spring hinges and prevent access to the ladder 1 by closing the gap between the risers 2 and 3 above the platform 39 substantially between the top rung of the ladder and the top hoop 5 of the cage 4.

The panel 6 has a lock (not shown) which co-operates with a catch, as described with reference to FIGS. 3 to 5, so that the panel closes and locks automatically from its open position.

Figure 8:
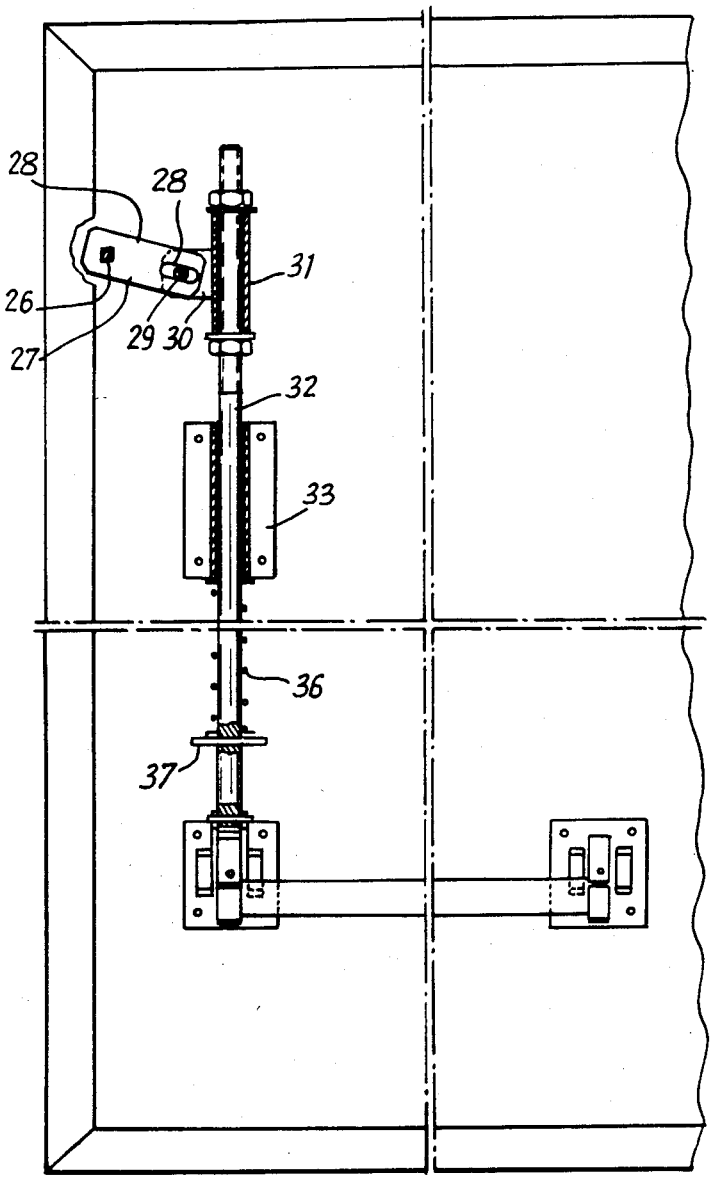
FIGS. 7 and 8 are fragmentary sections respectively showing the side and the front of the unlocking means of the FIG. 6 embodiment.
Figure 7:
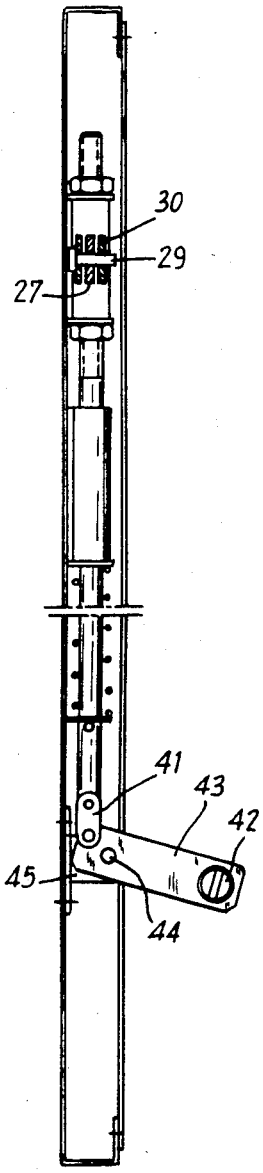
Figure 9:
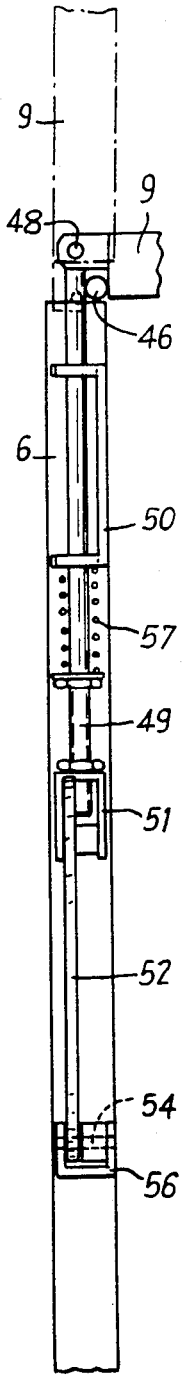
FIGS. 9 and 10 are fragmentary side and front views respectively of a mechanism for moving the closure flap relative to the panel.

The unlocking means is shown in detail in FIGS. 7 and 8. Running from the operating shaft 26 of the lock, it comprises the same parts 27 to 34 as described above, except that the slide rod 32 is shorter and no longer extends beyond the panel 6. In addition, it is the top end of the slide rod which operates the lock, while its bottom end is articulated by means of a link 41 (best seen in FIG. 7) with a rocking pushbar 42 located outside the panel 6.

The pushbar 42 is situated near the bottom of the panel 6 and in such a position as to be accessible from inside the cage by a person who has climbed to the top of the ladder 1. The pushbar 42 has end arms 43 which extend into the panel 6 and are articulated about a shaft 42 which is supported by a bearing 45.

In this example, the pushbar 42 which is hinged relative to the panel 6 constitutes the thrust element which was constituted by the pedal 35 in the example described with reference to FIGS. 3 to 5. The bar 42 could be surrounded on three sides in similar manner by a guard plate in order to prevent access thereto from outside the cage.

When the ladder is a downwardly extending ladder, it is particularly advantageous for the closure flap 9 to be hinged to the top edge 6A of the panel 6 by means of hinges 46 which enable the flap 9 to be folded into the plane of the panel 6 when the panel is in its open position. This arrangement is particularly useful when the panel 6 is capable of pivoting through only 90°, or thereabouts, from its closed position.

The panel 6 may be moved manually and means may be provided for holding it in each of its extreme positions.

Figure 6:
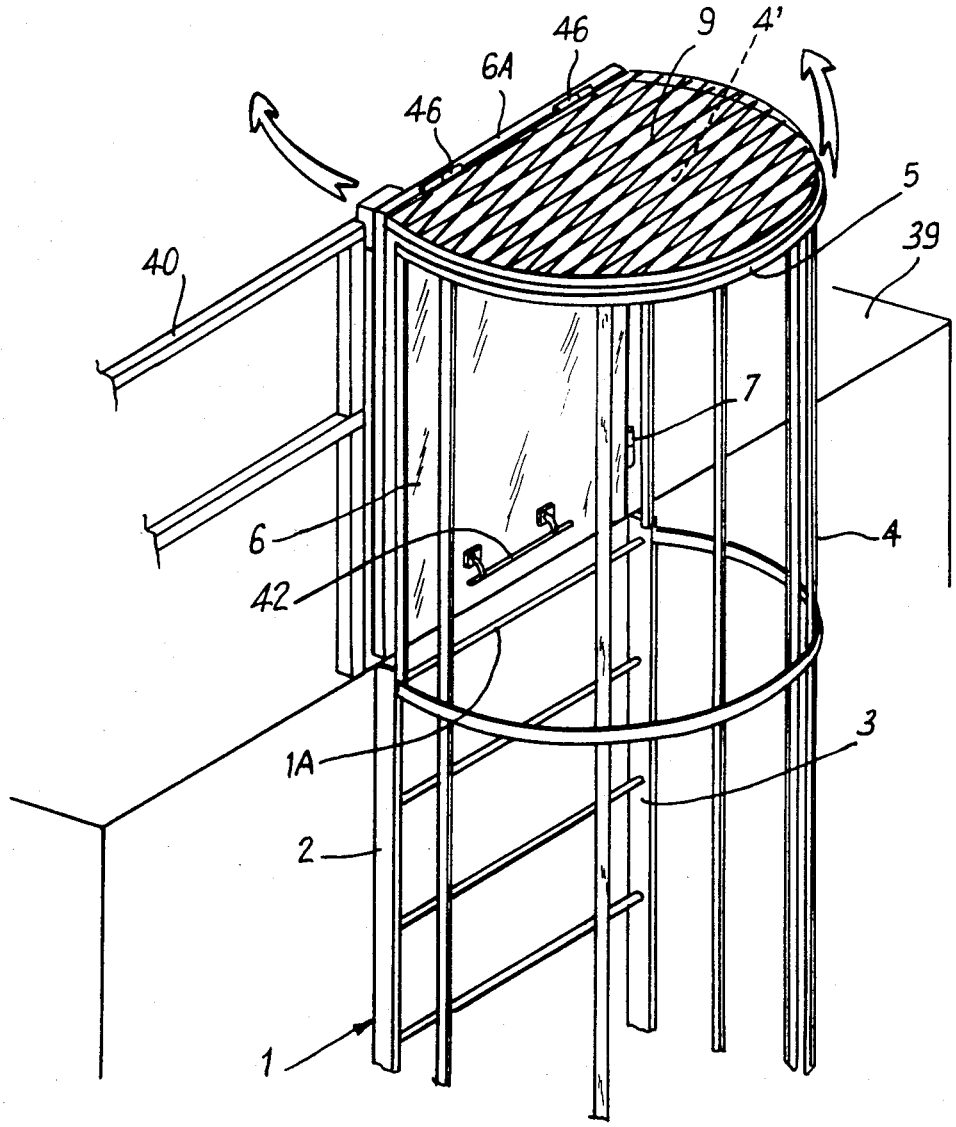
FIG. 6 is a perspective view of a caged ladder closed at its top end by a device in accordance with a preferred embodiment of the invention.

However, it is preferable to use an operating mechanism housed in the thickness of the panel 6 and capable of automatically moving the closure flap 9 between a first position where the flap is perpendicular to the panel 6 (as shown in FIG. 6) and a second position where it is raised above the panel 6 to occupy substantially the same plane as the panel.

The closure flap 9 is provided with a fork 47 located at its hinged end and preferably situated in a central position between the hinges 46. The fork 47 is articulated about an axis 48 to a rod 49 which extends downwardly into the thickness of the panel 6 where it is slidably guided by a guide 50. The other end of the rod 49 is located substantially in the middle of the panel 6 and includes a fork 51 whose arms enclose one end of a pusher 52. The pusher is semicircular in shape and it is hinged at two points which are substantially diametrically opposite to each other, one of said points being articulated to the fork 51 about an axis 53 and the other of said points being articulated to the panel 6 by means of a peg 54. The peg is free to slide in a slot 55 which is not parallel to the rod 49, and which is preferably perpendicular thereto. The slot 55 is provided in the flanges of a channel-section guide part 56 which is constituted by a portion of the panel 6.

Figure 10:
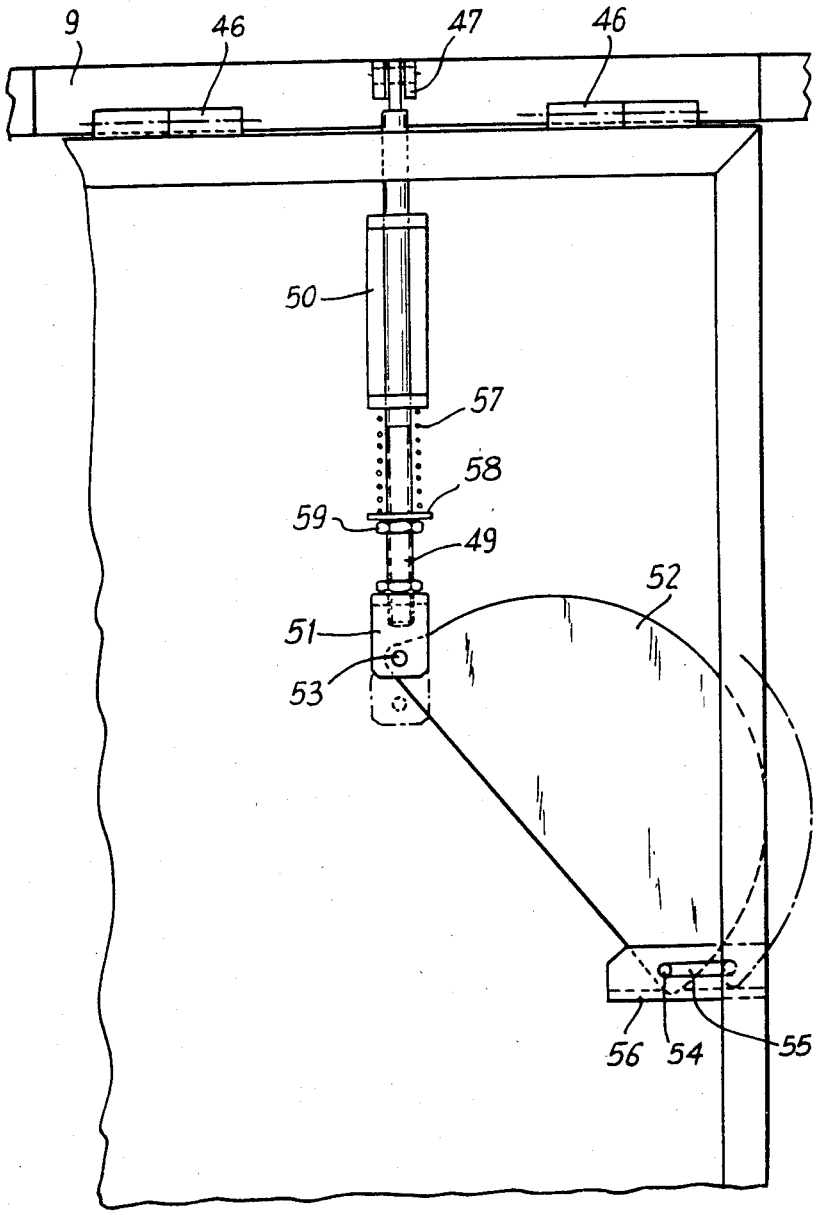

The pusher 52 is suitable for extending partially outside the panel 6 via a suitable opening through the longitudinal edge thereof on the side having the hinges 7 for fixing the panel 6 to the riser 3, as shown in dot-dashed lines in FIG. 10. When the pusher 52 is in this position, the peg 54 is at its outermost end of the slot 55. The fork 52 and the axis 53 are then in their innermost positions as also indicated in dot-dashed lines, thus causing the closure flap 9 to stand up as indicated in dot-dashed lines in FIG. 9. This situation may be obtained by means of a compression spring 57 which surrounds the rod 49 and which has one end bearing against the fixed guide 50 and which has its other end bearing against a washer 58 whose position along the rod 49 is held by a nut 59. The spring 57 provides at least a portion of the force required for lifting the closure flap 9 and it serves to hold it in the upright position.

When the pusher 52 is constrained to move back into the panel 6, for example because it abuts against the riser 3 as the panel 6 pivots towards a closed position, the peg 54 moves towards the inside end of the slot 55, and the axis 53 and the fork 51 move upwardly (as drawn in solid lines in FIG. 10) until the closure flap 9 occupies its closure position. In this state, the pusher is in abutment against the riser 3 so long as the panel 6 is in its closed position and it is not possible to lift the closure flap 9 without beginning by unlocking the panel 6 and moving it towards it open position. Only when the pusher 52 begins to move out from the panel 6 by virtue of the panel pivoting away from the riser 3 can the pusher begin to take its outwardly extended position, as explained above.

The mechanism for moving the closure flap may be mounted inside the thickness of the panel 6 in addition to the unlocking means described above.

Figure 11:
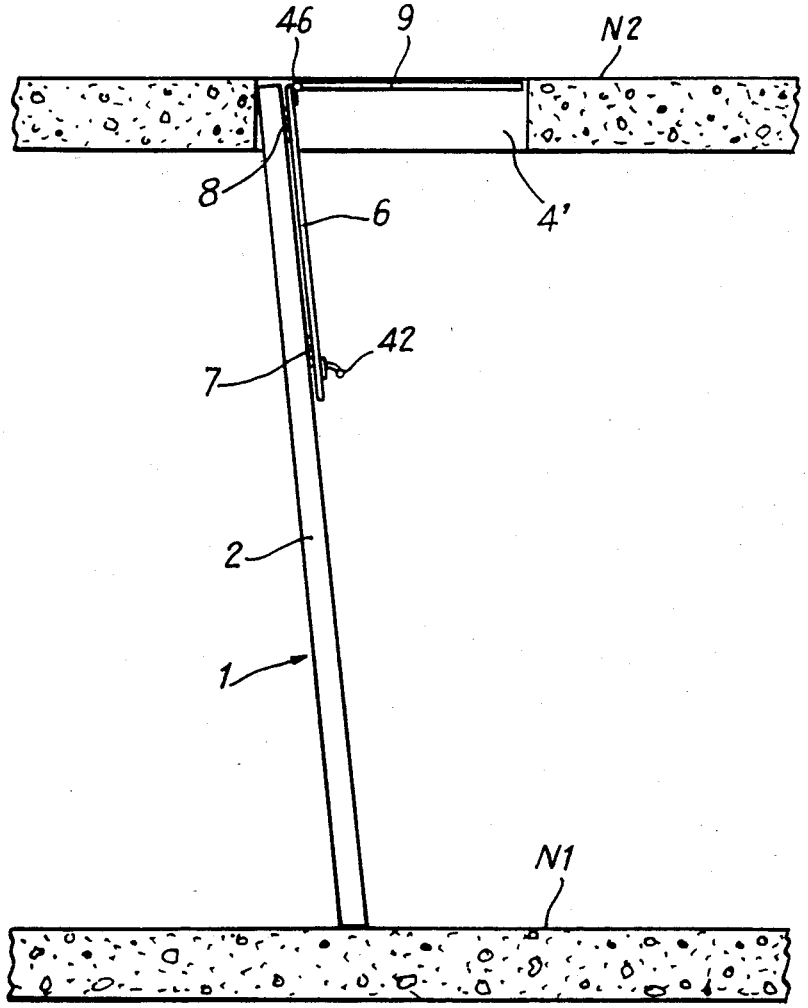
FIG. 11 is a diagram showing a ladder fitted with a device in accordance with the present invention and extending between a first level and a second level.

FIG. 11 shows a ladder 1 for providing access from a floor N1 situated at a first level to a floor N2 situated at a second level. A person-passing opening 4' is provided in the floor N2. The ladder 1 extends from the floor N1 up to the inside of person-passing opening 4'. The device in accordance with the invention may be identical, for example, to that described with reference to FIGS. 6 to 10. In this example, the ladder is not caged. When the device is in its closed position, the closure flap 9 extends horizontally and closes the person-passing opening 4', substantially in the same plane as the top face of the floor N2. Operation is the same as that described above, with the flap 9 pivoting about hinges 46, and with the panel 6 pivoting about hinges 7 and 8. The panel 6 could extend over the entire height of the ladder 1 between the floors N1 and N2. However, it is not essential for the panel 6 to cover the entire height. The invention extends to embodiments in which a pivoting panel 6 is associated with a closure flap 9, regardless of the vertical extent of the panel 6. The shortest practical height for the panel 6 is such as to be just large enough for the panel to be mounted on hinges 7 and 8 and for it to include the locking and unlocking means.

I claim:

1. A device for preventing access to a person-passing opening accessible via a ladder which extends between a first level and a second level at which said person-passing opening is situated, wherein a panel of width substantially equal to the width of the ladder and of height equal to at least a fraction of the difference between said first and second levels is mounted to pivot relative to the ladder, the end of said panel which is closest to said person-passing opening, when in use, being provided with a closure flap of a size suitable to close said person-passing opening sufficiently to prevent a person from passing therethrough, said flap being disposed to close said opening when said panel is itself in a closed position close to said ladder, said panel being further provided with locking and unlocking means for locking said panel in its closed position, and for unlocking it.

2. A device for preventing access to a person-passing opening accessible via a caged ladder, said ladder including two risers and an end rung, and being enclosed in a cage which is terminated by an end hoop which is located at the same end of the cage as said end rung of the ladder and which defines said person-passing opening, with said end rung and said end hoop being separated by a fixed distance, the device comprising a panel mounted to pivot relative to the ladder between an open position in which the panel leaves access to the ladder and closed position in which the panel is close to the risers of the ladder and in which it prevents access to the ladder, the width of the panel being at least substantially equal to the width of the ladder, and the height of the panel being equal to at least a fraction of said fixed distance between the end rung and the end hoop, the top of the panel being provided with a closure flap of a size suitable, when the panel is in its closed position, to prevent a person from passing through said person-passing opening, said panel being further provided with locking and unlocking means for locking said panel in its closed position, and for unlocking it.

3. A device according to claim 2, wherein the locking and unlocking means comprise firstly an unlocking member which is accessible from inside the cage and secondly a key-operated lock which is accessible from outside the cage.

4. A device according to claim 3, further including automatic panel closure means such as a spring, a counterweight, offset hinges, or spring hinges.

5. A device according to claim 2, wherein the locking and unlocking means include firstly a locking tab fixed to the panel and secondly a locking element fixed to the ladder, said tab and said element having respective holes therethrough, and said holes coming into correspondence to receive a padlock when said panel is in its closed position.

6. A device according to claim 5, wherein the mid portion of the locking element is pivotally mounted about an axis carried by one of the risers of the ladder, and is articulated with a first link which extends upwardly towards an intermediate lever whose middle portion is pivotally mounted about a horizontal axis carried by the same riser of the ladder, at a level above the closure flap, said intermediate lever having a stop finger for preventing the closed panel from being opened when said intermediate lever is one of its positions, and which allows said panel to be opened when said intermediate lever is in its other position, said intermediate lever being additionally articulated to a second link which extends upwardly parallel to the riser to a point where it is articulated to an operating lever which is pivotally mounted about a horizontal axis carried by the same riser.

7. A device according to claim 6, wherein the positions of the locking element and the operating lever are opposite such that the stop finger is in position to hold the panel closed when the locking element is in a position which does not allow a padlock to be put into place.

8. A device according to claim 6, wherein the positions of the locking element and the operating lever are parallel such that they are simultaneously in their positions for locking or retaining the panel in its closed position.

9. A device according to claim 3, wherein the locking and unlocking means comprise a spring-bolt lock capable of locking automatically when the panel is slammed to its closed position, said lock being preferably mounted on the panel and in a position to co-operate with a catch member fixed to the ladder, said lock being operable from outside by means of a key and having a bolt-operating shaft which is functionally connected to an unlocking member.

10. A device according to claim 9, wherein the unlocking portion of the locking and unlocking means is preferably lodged within the thickness of the panel and comprises a rod which is slidable against the action of a return spring and which is operatively coupled to the bolt-operating shaft of the lock, said rod being provided with a thrust element which is operable from inside the cage when the panel is in its closed position.

11. A device according to claim 10, for use with a rising ladder, wherein the sliding rod extends above the top edge of the panel and wherein its free end is preferably provided with a pedal which constitutes said thrust element.

12. A device according to claim 10, for use with a downwardly extending ladder, wherein the slide rod is operatively connected to a rocking bar which is hinged relative to the panel and which constitues the thrust element.

13. A device according to claim 2, wherein the closure flap is hinged relative to the panel and is movable to occupy substantially the same plane as the panel when the panel is in its open position.

14. A device according to claim 13, wherein the panel is provided with a mechanism for automatically moving the closure flap.

15. A device according to claim 14, wherein the mechanism for automatically moving the closure flap is preferably housed within the thickness of the panel and comprises a sliding rod hinged at one end to the closure flap and at the other end to a pusher suitable for pressing against one of the risers of the ladder and being pressed against said riser when the panel is in its closed position, thereby causing the closure flap to take up its closed position.

* * * * *